US010892551B2

(12) United States Patent
Dong et al.

(10) Patent No.: US 10,892,551 B2
(45) Date of Patent: Jan. 12, 2021

(54) PHASE SHIFTER AND MANUFACTURING METHOD THEREOF, LIQUID CRYSTAL ANTENNA AND COMMUNICATION DEVICE

(71) Applicants: BOE Technology Group Co., Ltd., Beijing (CN); Beijing BOE Optoelectronics Technology Co., Ltd., Beijing (CN)

(72) Inventors: Tingze Dong, Beijing (CN); Jingpeng Li, Beijing (CN); Yongshan Zhou, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 188 days.

(21) Appl. No.: 15/993,842

(22) Filed: May 31, 2018

(65) Prior Publication Data

US 2019/0103671 A1 Apr. 4, 2019

(30) Foreign Application Priority Data

Sep. 29, 2017 (CN) ..... 2017 1 0908038

(51) Int. Cl.
*H01Q 1/14* (2006.01)
*H01Q 3/36* (2006.01)
(Continued)

(52) U.S. Cl.
CPC ..... *H01Q 3/36* (2013.01); *H01Q 1/364* (2013.01); *H01Q 3/44* (2013.01); *H01Q 9/0407* (2013.01)

(58) Field of Classification Search
CPC ..... H01Q 3/36; H01Q 3/44; H01Q 9/0407; H01Q 1/364; H01Q 1/14; H01Q 5/307; H01Q 5/10
See application file for complete search history.

(56) References Cited

U.S. PATENT DOCUMENTS

2012/0044445 A1* 2/2012 Monma ..... G02F 1/1345 349/123
2016/0370631 A1 12/2016 Tang et al.
2019/0146248 A1* 5/2019 Wang ..... H01Q 1/364 349/1

FOREIGN PATENT DOCUMENTS

CN 104865754 A 8/2015
CN 105006656 A 10/2015
(Continued)

OTHER PUBLICATIONS

First office action of Chinese application No. 2017109080382 dated Apr. 29, 2019.
(Continued)

*Primary Examiner* — Awat M Salih
(74) *Attorney, Agent, or Firm* — Fay Sharpe LLP

(57) ABSTRACT

A phase shifter and a manufacturing method thereof, a liquid crystal antenna and a communication device are provided. The phase shifter includes: a first substrate and a second substrate which are oppositely arranged; and a sealing frame structure located in peripheral regions of the first substrate and the second substrate for fixing relative positions of the two substrates to form a gap for accommodating a liquid crystal material; wherein the sealing frame structure includes a support, and sealant for bonding to the first substrate, on the support. It is able to facilitate the increase in the adjusting range of the resonant frequency of the liquid crystal antenna by the phase shifter and the manufacturing method thereof.

15 Claims, 7 Drawing Sheets

(51) Int. Cl.

| | |
|---|---|
| ***H01Q 1/36*** | (2006.01) |
| ***H01Q 9/04*** | (2006.01) |
| ***H01Q 3/44*** | (2006.01) |

(56) References Cited

FOREIGN PATENT DOCUMENTS

| | | | | |
|---|---|---|---|---|
| CN | 105896082 | A | | 8/2016 |
| CN | 106932933 | A | | 7/2017 |
| CN | 107167941 | | * | 9/2017 |
| CN | 107167941 | A | | 9/2017 |
| JP | 2012141606 | | * | 7/2012 |
| JP | 2012141606 | A | | 7/2012 |

OTHER PUBLICATIONS

Second office action of Chinese application No. 201710908038.2
dated Dec. 4, 2019.

* cited by examiner

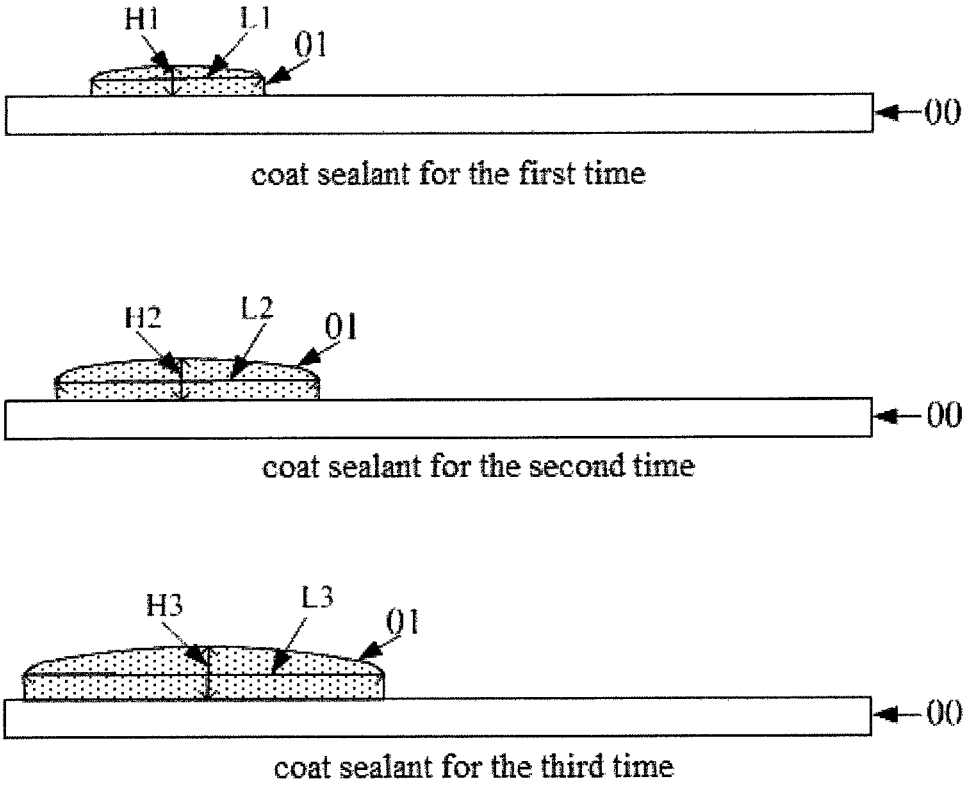
FIG. 1 (the related art)
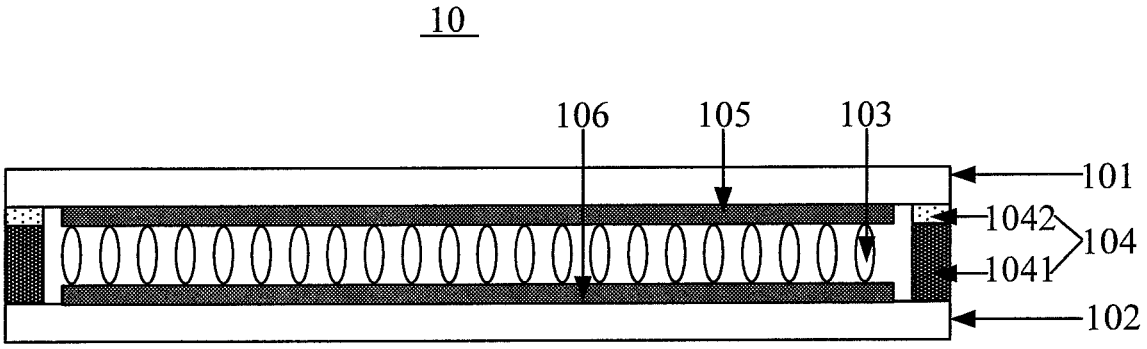
FIG. 2

PHASE SHIFTER AND MANUFACTURING METHOD THEREOF, LIQUID CRYSTAL ANTENNA AND COMMUNICATION DEVICE

This application claims priority to Chinese Patent Application No. 201710908038.2, filed with the State Intellectual Property Office on Sep. 29, 2017 and titled "Antenna Unit and Manufacturing Method thereof, Liquid Crystal Antenna and Communication Device," the entire contents of which are incorporated herein by reference.

TECHNICAL FIELD

The present disclosure relates to a phase shifter and a manufacturing method thereof, a liquid crystal antenna and a communication device.

BACKGROUND

A liquid crystal antenna is a micro antenna that uses the deflection of liquid crystals to adjust the resonant frequency. The liquid crystal antenna usually comprises a plurality of phase shifters. Each of the phase shifters comprises a first substrate and a second substrate which are oppositely arranged, as well as liquid crystals and sealant, which are located between the first substrate and the second substrate. A grounding electrode is arranged at the side, close to the liquid crystals, of the first substrate. A patch electrode is arranged at the side, close to the liquid crystals, of the second substrate. An orthographic projection of the sealant on the first substrate is located in a peripheral region of the first substrate. The liquid crystals are located in a space defined by the sealant. When a voltage is applied to the grounding electrode and the patch electrode, an electric field is formed between the first substrate and the second substrate. The electric field drives the liquid crystals to deflect so as to adjust the resonant frequency of the phase shifter. Thus, the resonant frequency of the liquid crystal antenna is adjusted.

In order to enable the liquid crystals to deflect at different angles so as to adjust the resonant frequency of the liquid crystal antenna in a wide range, it needs to maintain a sufficient gap between the first substrate and the second substrate. In the related art, the gap between the first substrate and the second substrate is maintained depending on the sealant mainly. Exemplarily, in a manufacturing process of the phase shifter, firstly, the peripheral region of the first substrate is coated with the sealant, and in order to maintain the gap between the first substrate and the second substrate, the peripheral region of the first substrate may be coated with the sealant for multiple times. Then, the liquid crystals are dropped into a central region of the second substrate and subsequently, the first substrate and the second substrate are assembled so as to make the liquid crystals located in the space defined by the sealant. Finally, the sealant is cured, thereby obtaining the phase shifter.

SUMMARY

The present disclosure provides a phase shifter and a manufacturing method thereof, a liquid crystal antenna and a communication device.

In a first aspect, there is provided a phase shifter, including: a first substrate and a second substrate which are oppositely arranged; and a sealing frame structure located in peripheral regions of the first substrate and the second substrate for fixing relative positions of the two substrates to form a gap for accommodating a liquid crystal material; wherein the sealing frame structure comprises a support, and sealant for bonding to the first substrate, on the support.

In some embodiments, the sealing frame structure further comprises sealant for bonding to the second substrate, on the support.

In some embodiments, a forming material of the support is the same as that of the first substrate or that of the second substrate.

In some embodiments, the support is annularly distributed in the peripheral region of the first substrate, or the support is annularly distributed in the peripheral region of the second substrate.

In some embodiments, the support is provided with a wiring groove, and the wiring groove is used for distribution of a lead of the phase shifter.

In some embodiments, the support is integrally formed with the first substrate; or the support is integrally formed with the second substrate.

In some embodiments, the phase shifter further includes: an alignment layer arranged on at least one of the first substrate and the second substrate.

In some embodiments, the phase shifter further comprises: a plurality of coils, wherein a terminal of each of the coils extends out from a region defined by the support, through the wiring groove on the support.

In some embodiments, a patch electrode is arranged at the side, close to the liquid crystal material, of the first substrate, and a grounding electrode is arranged at the side, close to the liquid crystal material, of the second substrate, or the grounding electrode is arranged at the side, close to the liquid crystal material, of the first substrate, and the patch electrode is arranged at the side, close to the liquid crystal material, of the second substrate.

In a second aspect, there is provided a manufacturing method for a phase shifter, including: forming a first substrate and a second substrate; and oppositely arranging the first substrate and the second substrate to form a sealing frame structure in peripheral regions of the first substrate and the second substrate for fixing relative positions of the two substrates to form a gap for accommodating a liquid crystal material; wherein the sealing frame structure comprises a support, and sealant for bonding to the first substrate, on the support.

In some embodiments, the sealing frame structure further comprises sealant for bonding to the second substrate, on the support.

In some embodiments, a forming material of the support is the same as that of the first substrate or that of the second substrate.

In some embodiments, forming a first substrate and a second substrate comprises: forming the first substrate and the second substrate, wherein the support is formed on the first substrate and the support is annularly distributed in the peripheral region of the first substrate, or forming the first substrate and the second substrate, wherein the support is formed on the second substrate and the support is annularly distributed in the peripheral region of the second substrate.

In some embodiments, the support is integrally formed with the first substrate; or the support is integrally formed with the second substrate.

In some embodiments, said oppositely arranging the first substrate and the second substrate to form a sealing frame structure in peripheral regions of the first substrate and the second substrate comprises: coating the support with the sealant; and oppositely arranging the first substrate and the second substrate through the sealant to form the sealing frame structure in peripheral regions of the first substrate and the second substrate.

In a third aspect, there is provided a liquid crystal antenna comprising at least one phase shifter, wherein each phase shifter comprises: a first substrate and a second substrate which are oppositely arranged; and a sealing frame structure located in peripheral regions of the first substrate and the second substrate for fixing relative positions of the two substrates to form a gap for accommodating a liquid crystal material; wherein the sealing frame structure comprises a support, and sealant for bonding to the first substrate, on the support.

In some embodiments, the sealing frame structure further comprises sealant for bonding to the second substrate, on the support.

In some embodiments, a forming material of the support is the same as that of the first substrate or that of the second substrate.

In some embodiments, the support is annularly distributed in the peripheral region of the first substrate, or the support is annularly distributed in the peripheral region of the second substrate.

In a fourth aspect, there is provided a communication device comprising the liquid crystal antenna in the third aspect.

It is to be understood that both the foregoing general description and the following detailed description are exemplary and explanatory only and are not restrictive of the present disclosure.

BRIEF DESCRIPTION OF THE DRAWINGS

FIG. 1 is a diagram of changes of a sealant after the sealant is coated for multiple times in embodiments of the related art;

FIG. 2 is a structural diagram of a liquid crystal antenna provided in an embodiment of the present disclosure;

DETAILED DESCRIPTION

Figure 3:
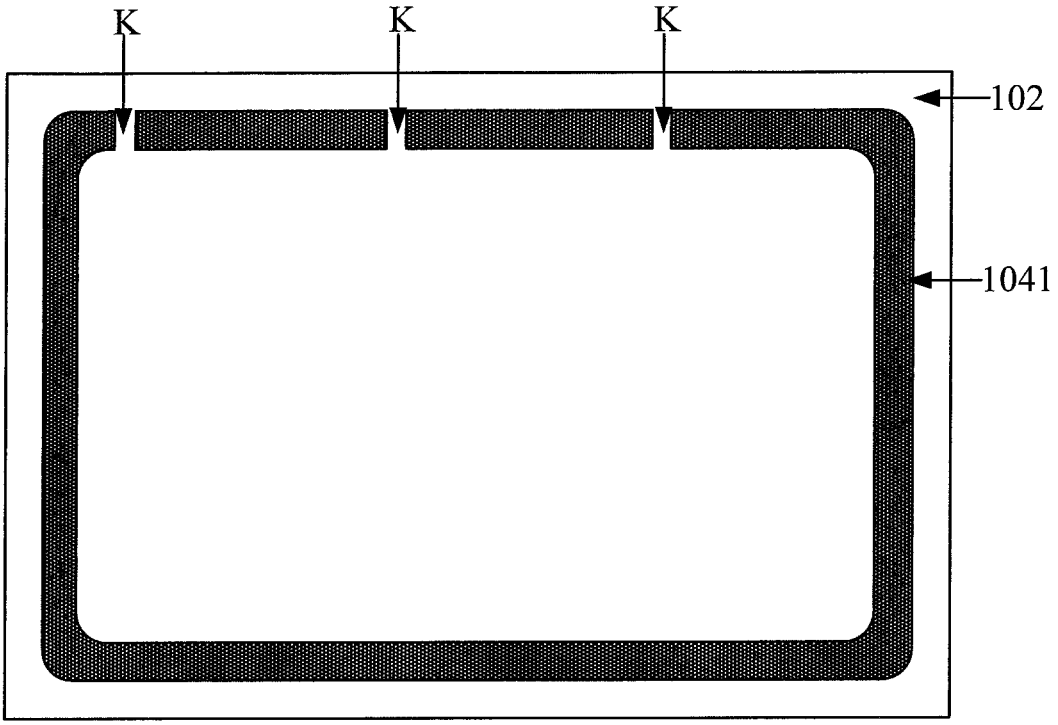
FIG. 3 is diagram of a position relationship diagram of a support and a second substrate provided in an embodiment of the present disclosure.

The present disclosure will be described in further detail with reference to the enclosed drawings, to clearly present the principles, and advantages of the present disclosure. The embodiments described are only some embodiments of the present disclosure, rather than all embodiments.

A liquid crystal antenna usually comprises a plurality of phase shifters. In order to enable liquid crystals to deflect at different angles so as to adjust the resonant frequency of the liquid crystal antenna in a wide range, it needs to maintain a sufficient gap between a first substrate and a second substrate. The amount of sealant, with which a peripheral region of the first substrate is coated, is limited and it is difficult to maintain the gap between the first substrate and the second substrate by coating of the sealant for one time. Therefore, in a manufacturing process of a phase shifter at present, the peripheral region of the first substrate may be coated with the sealant for multiple times to increase the thickness of the sealant, thereby maintaining the gap between the first substrate and the second substrate through the sealant. The coating of the sealant may also be referred to as drawing of the sealant.

However, the coating of the sealant for multiple times not only causes the waste of the sealant, but also easily causes the problem of sealant collapse. Exemplarily, as shown in FIG. 1, which shows a diagram of changes in height and width of the sealant 01 after the first substrate 00 is coated with the sealant 01 for multiple times (three times in FIG. 1). With reference to FIG. 1, after the first substrate 00 is coated with the sealant 01 for the first time, the height of the sealant 01 is H1 and the width thereof is L1. After the first substrate 00 is coated with the sealant 01 for the second time, the height of the sealant 01 is increased to H2 and the width thereof is increased to L2. After the first substrate 00 is coated with the sealant 01 for the third time, the height of the sealant 01 is increased to H3 and the width thereof is increased to L3. It can be seen from FIG. 1 that after coating of the sealant 01 for multiple times, an increase in the width of the sealant 01 is greater than an increase in the height thereof. As a result, a transverse diffusion speed of the sealant 01 is greater than a height increase speed, and consequently the problem of sealant collapse is relatively serious.

A phase shifter provided in the embodiments of the present disclosure may avoid the problem of sealant collapse while maintaining the gap between the first substrate and the second substrate. The phase shifter, a liquid crystal antenna and the like provided in the embodiments of the present disclosure are described with reference to the following embodiments.

With reference to FIG. 2, which shows a structural diagram of a phase shifter 10 provided in the embodiments of the present disclosure. With reference to FIG. 2, the phase shifter 10 comprises a first substrate 101 and a second substrate 102 which are oppositely arranged, and a sealing frame structure 104 located in peripheral regions of the first substrate 101 and the second substrate 102 for fixing relative positions of the two substrates to form a gap for accommodating a liquid crystal material 103. The sealing frame structure 104 comprises a support 1041, and sealant 1042 for bonding to the first substrate 101, on the support 1041.

The peripheral regions are regions around regions in which projections of liquid crystals, between the first substrate and the second substrate, on the substrates are located.

To sum up, in the phase shifter provided in the embodiments of the present disclosure, the sealing frame structure comprises the support and the sealant, and the gap between the first substrate and the second substrate is maintained by adopting the support and the sealant, so that the problem of sealant collapse caused by coating of the sealant for multiple times may be avoided. Therefore, the problem in the related art that an adjusting range of the resonant frequency of the liquid crystal antenna is relatively narrow because it is difficult to maintain the gap between the first substrate and the second substrate is solved, thereby facilitating the increase in the adjusting range of the resonant frequency of the liquid crystal antenna.

A forming material of the support is the same as that of the first substrate or that of the second substrate.

In some embodiments, as shown in FIG. 2, a patch electrode 105 is arranged at the side, close to the liquid crystal material 103, of the first substrate 101, and a grounding electrode 106 is arranged at the side, close to the liquid crystal material 103, of the second substrate 102.

Or the grounding electrode is arranged at the side, close to the liquid crystal material, of the first substrate, and the patch electrode is arranged at the side, close to the liquid crystal material, of the second substrate.

When the patch electrode is arranged at the side, close to the liquid crystal material, of the first substrate, and the grounding electrode is arranged at the side, close to the liquid crystal material, of the second substrate, the sealing frame structure comprises the sealant for bonding to the substrate provided with the patch electrode, on the support. When the grounding electrode is arranged at the side, close to the liquid crystal material, of the first substrate, and the patch electrode is arranged at the side, close to the liquid crystal material, of the second substrate, as shown in FIG. 2, the sealing frame structure 104 comprises the sealant 1042 for bonding to the substrate provided with the grounding electrode 106, on the support 1041.

In some embodiments of the present disclosure, the support 1041 may be annularly distributed in the peripheral region of the first substrate 101; or the support 1041 may be annularly distributed in the peripheral region of the second substrate 102. The support may be a square loop. In some embodiments, the support 1041 may be provided with a wiring groove. The wiring groove is used for distribution of a lead of the phase shifter 10. In the embodiments of the present disclosure, when the support 1041 is annularly distributed in the peripheral region of the first substrate 101, the support 1041 may be integrally formed with the first substrate 101; or when the support 1041 is annularly distributed in the peripheral region of the second substrate 102, the support 1041 may be integrally formed with the second substrate 102. The embodiment of the present disclosure is described by taking an example in which the support 1041 is annularly distributed in the peripheral region of the second substrate 102. With reference to FIG. 3, which shows a position relationship diagram of the support 1041 and the second substrate 102 provided in the embodiments of the present disclosure. With reference to FIG. 3, the support 1041 is annularly distributed in the peripheral region of the second substrate 102. The support 1041 is provided with the wiring groove K. The wiring groove K is used for distribution of the lead of the phase shifter 10.

In the embodiments of the present disclosure, the sealing frame structure may further comprise sealant for bonding to the second substrate, on the support. That is, the sealant may be bonded to any of the two substrates, and may also be bonded to the two substrates at the same time. For example, when the support is annularly distributed in the peripheral region of the first substrate, the sealant is bonded to the second substrate. For another example, when the support is annularly distributed in the peripheral region of the second substrate 102, as shown in FIG. 2, the sealant is bonded to the first substrate 101. Moreover, the sealant may also be bonded to the first substrate and the second substrate at the same time.

Figure 4:
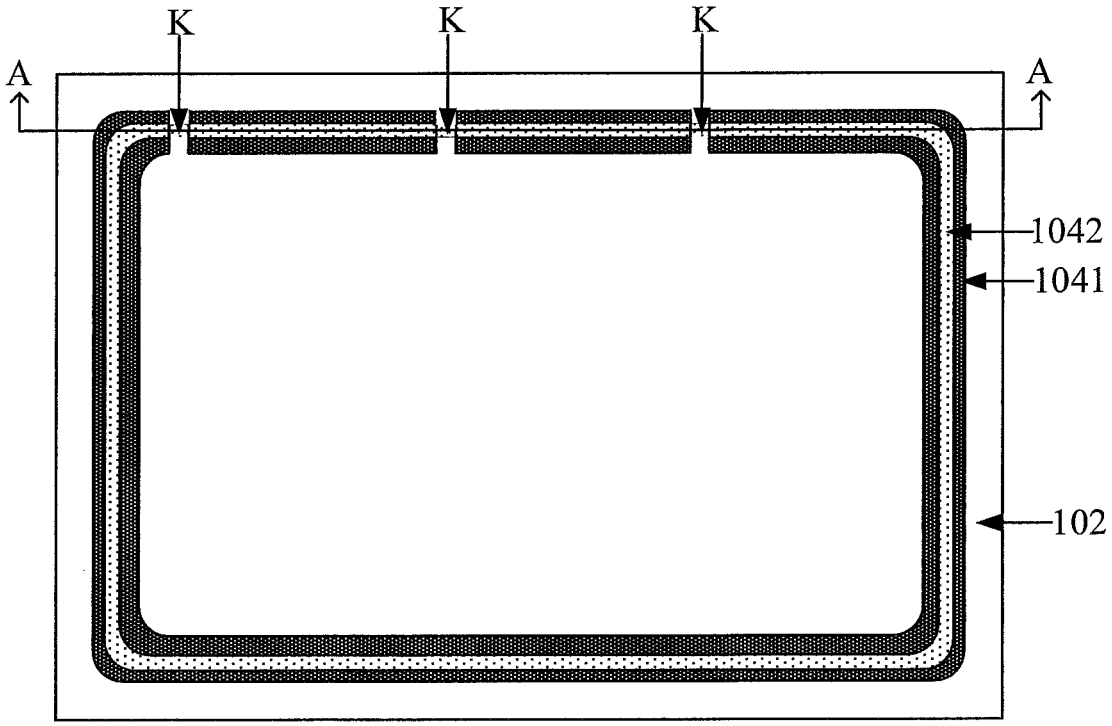
FIG. 4 is a diagram of a support after being coated with a sealant provided in an embodiment of the present disclosure.
Figure 5:
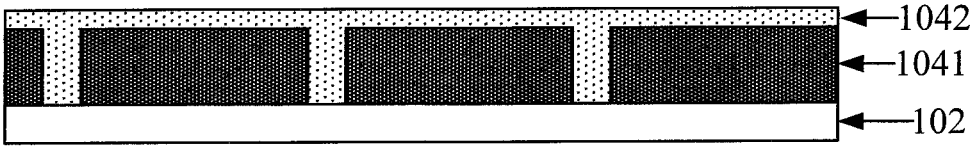
FIG. 5 is a sectional view of FIG. 4 provided in an embodiment of the present disclosure.
Figure 6:
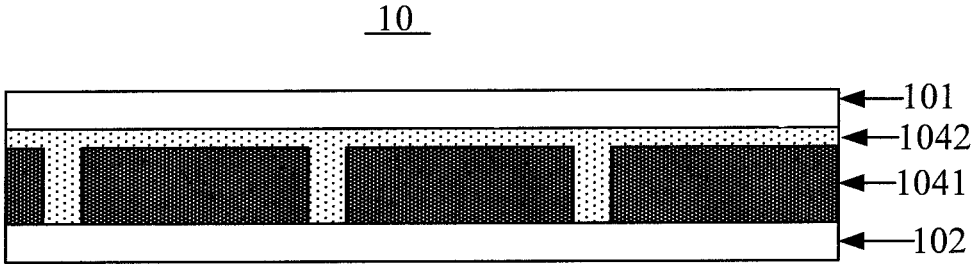
FIG. 6 is a structural diagram of another liquid crystal antenna provided in an embodiment of the present disclosure.

In the embodiments of the present disclosure, after the sealant 1042 is arranged on the support 1041, the sealant 1042 is also arranged in the wiring groove. Exemplarily, with reference to FIGS. 4, 5 and 6, FIG. 4 is a diagram after the support 1041 shown in FIG. 3 is coated with the sealant 1042, provided in the embodiments of the present disclosure. FIG. 5 is a sectional view of an A-A portion in FIG. 4. FIG. 6 is a structural diagram of another phase shifter 10 provided in the embodiments of the present disclosure. With reference to FIGS. 4 to 6, the sealant 1042 is arranged on the support 1041 and in the wiring groove K. The support 1041 is bonded to the first substrate 101 through the sealant 1042.

Figure 7:
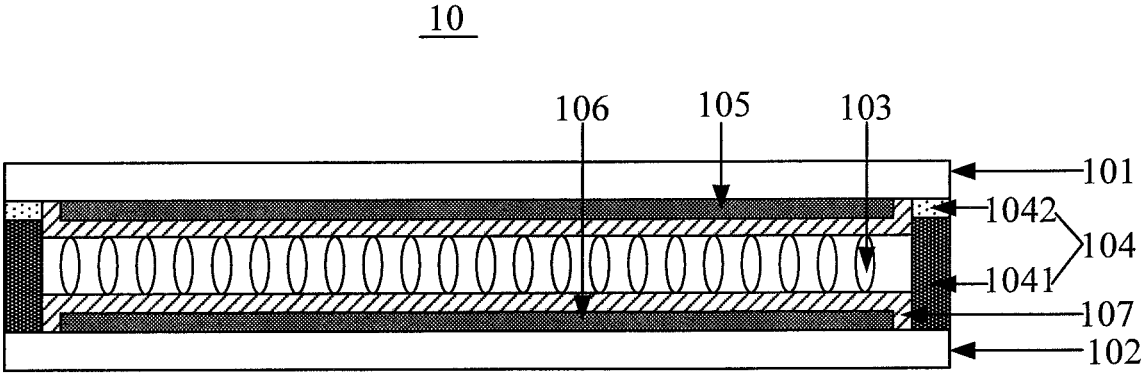
FIG. 7 is a structural diagram of yet another liquid crystal antenna provided in an embodiment of the present disclosure.

In some embodiments, with reference to FIG. 7, which shows a structural diagram of still another phase shifter 10 provided in the embodiments of the present disclosure. With reference to FIG. 7, on the basis of FIG. 2, the phase shifter 10 further comprises an alignment layer 107 arranged on at least one of the first substrate 101 and the second substrate 102. That is, the alignment layer 107 may be only arranged on the first substrate 101 or the alignment layer 107 may be only arranged on the second substrate 102 or the alignment layers 107 may be arranged on both the first substrate 101 and the second substrate 102. FIG. 7 gives the description by taking an example in which the alignment layers 107 are arranged on both the first substrate 101 and the second substrate 102. In the embodiments of the present disclosure, the alignment layer 107 may be formed by adopting polyimide (PI).

Figure 8:
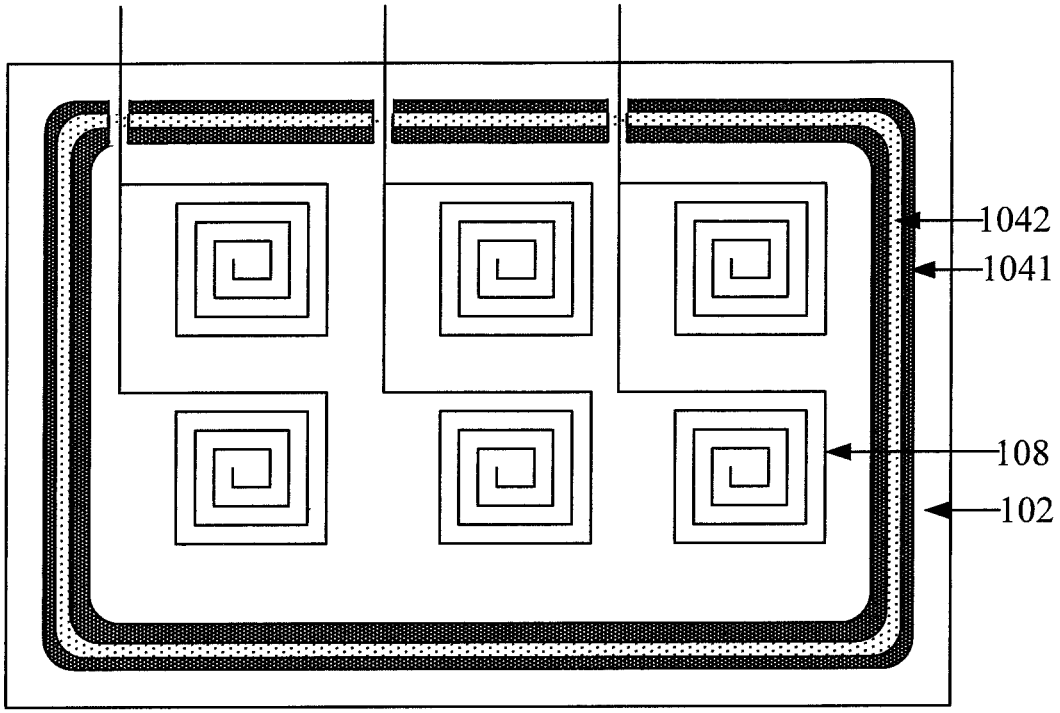
FIG. 8 is a top view of a liquid crystal antenna provided in an embodiment of the present disclosure.

With reference to FIG. 8 which shows a top view of a phase shifter provided in the embodiments of the present disclosure. The first substrate 101 is not shown in FIG. 8. With reference to FIG. 8, the phase shifter further comprises a plurality of coils 108, a terminal of each of the coils 108 extends out from a region defined by the support 1041, through the wiring groove K on the support 1041. The plurality of coils 108 may be connected to the patch electrode, or in practical application, there may be a plurality of patch electrodes. Each of the patch electrodes may take the shape of a coil, namely, each of the patch electrodes is a coil. This is not limited in the embodiments of the present disclosure.

It should be noted that in the embodiments of the present disclosure, both the first substrate 101 and the second substrate 102 may be transparent substrates, and specifically may be substrates made of light-guide and non-metallic materials having a certain robustness such as glass, quartz and transparent resin, or the first substrate 101 and the second substrate 102 may also be non-transparent substrates. The support 1041 may be integrally formed with the first substrate 101 or the second substrate 102. Therefore, a forming material of the support 1041 is the same as that of the first substrate 101 or that of the second substrate 102. The patch electrode 105 and the grounding electrode 106 may be formed by adopting metal Mo, metal Cu, metal Al and an alloy material thereof or the patch electrode 105 and the grounding electrode 106 may be formed by adopting indium tin oxide (ITO) or indium zinc oxide (IZO). The structures of the patch electrode 105 and the grounding electrode 106 may make reference to related art, which is not repeated herein.

In practical application, in order to meet an adjusting requirement for the resonant frequency of the liquid crystal antenna, the gap between the first substrate and the second substrate needs to reach 0.1 mm above. The gap between the first substrate and the second substrate is maintained by adopting the sealant in the related art, which hardly meets this requirement. In the embodiments of the present disclosure, by arranging the support which may effectively support the first substrate and the second substrate and increases the height of a position where the sealant is located, the gap between the first substrate and the second substrate meets the above requirement. Moreover, in the embodiments of the present disclosure, there is no need of coating of the sealant for multiple times, thereby avoiding the waste of the sealant. Moreover, the support arranged in the embodiments of the present disclosure may further resist height impact of the liquid crystals.

To sum up, in the phase shifter provided in the embodiments of the present disclosure, the sealing frame structure comprises the support and the sealant, and the gap between the first substrate and the second substrate is maintained by adopting the support and the sealant, so that the problem of sealant collapse caused by coating of the sealant for multiple times may be avoided. Therefore, the problem in the related art that the adjusting range of the resonant frequency of the liquid crystal antenna is relatively narrow because it is difficult to maintain the gap between the first substrate and the second substrate is solved, thereby facilitating the increase in the adjusting range of the resonant frequency of the liquid crystal antenna.

The phase shifter provided in the embodiments of the present disclosure may be applied to methods below. Manufacturing methods and manufacturing principles of the phase shifter provided in the embodiments of the present disclosure may make reference to the description in various embodiments below.

Figure 9:
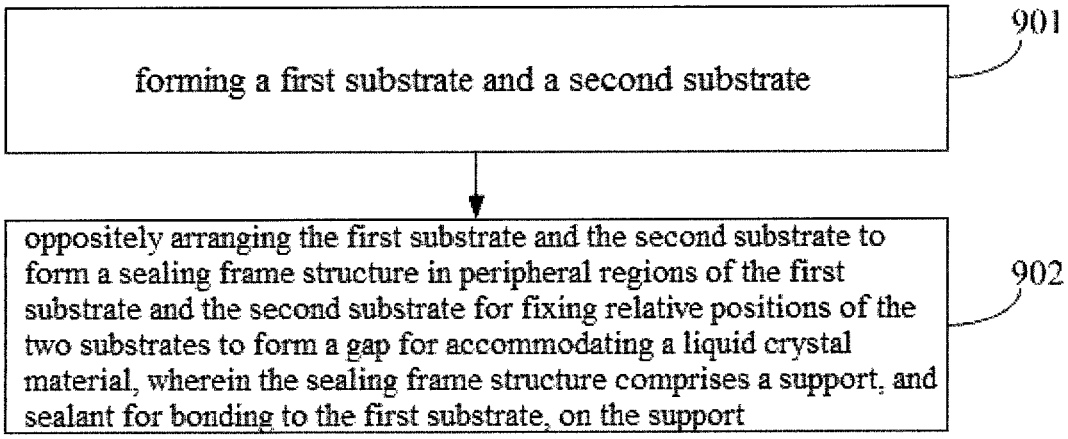
FIG. 9 is a flow chart of a manufacturing method of a liquid crystal antenna provided in an embodiment of the present disclosure.

With reference to FIG. 9 which shows a method flow chart of a manufacturing method for a phase shifter provided in the embodiments of the present disclosure. The manufacturing method for the phase shifter may be applied to manufacture the phase shifter 10 shown in FIG. 2 or any of FIGS. 6 to 8. With reference to FIG. 9, the method comprises the steps as follows.

Step 901 includes forming a first substrate and a second substrate.

Step 902 includes oppositely arranging the first substrate and the second substrate to form a sealing frame structure in peripheral regions of the first substrate and the second substrate for fixing relative positions of the two substrates to form a gap for accommodating a liquid crystal material, wherein the sealing frame structure comprises a support, and sealant for bonding to the first substrate, on the support.

In some embodiments, the sealing frame structure further comprises sealant for bonding to the second substrate, on the support.

In some embodiments, a forming material of the support is the same as that of the first substrate or that of the second substrate.

In some embodiments, step 901 comprises the steps as follows:

forming the first substrate and the second substrate, wherein the support is formed on the first substrate and the support is annularly distributed in the peripheral region of the first substrate; or forming the first substrate and the second substrate, wherein the support is formed on the second substrate and the support is annularly distributed in the peripheral region of the second substrate.

In some embodiments, the support is integrally formed with the first substrate are or the support is integrally formed with the second substrate.

In some embodiments, step 902 comprises the steps as follows: coating the support with the sealant; oppositely arranging the first substrate and the second substrate through the sealant to form the sealing frame structure in peripheral regions of the first substrate and the second substrate.

In some embodiments, prior to step 902, the method further comprises: forming an alignment layer on at least one of the first substrate and the second substrate.

To sum up, in the manufacturing method for the phase shifter provided in the embodiments of the present disclosure, the sealing frame structure comprises the support and the sealant, and the gap between the first substrate and the second substrate is maintained by adopting the support and the sealant, so that the problem of sealant collapse caused by coating of the sealant for multiple times may be avoided. Therefore, the problem in the related art that the adjusting range of the resonant frequency of the liquid crystal antenna is relatively narrow because it is difficult to maintain the gap between the first substrate and the second substrate is solved, thereby facilitating the increase in the adjusting range of the resonant frequency of the liquid crystal antenna.

Figure 10:
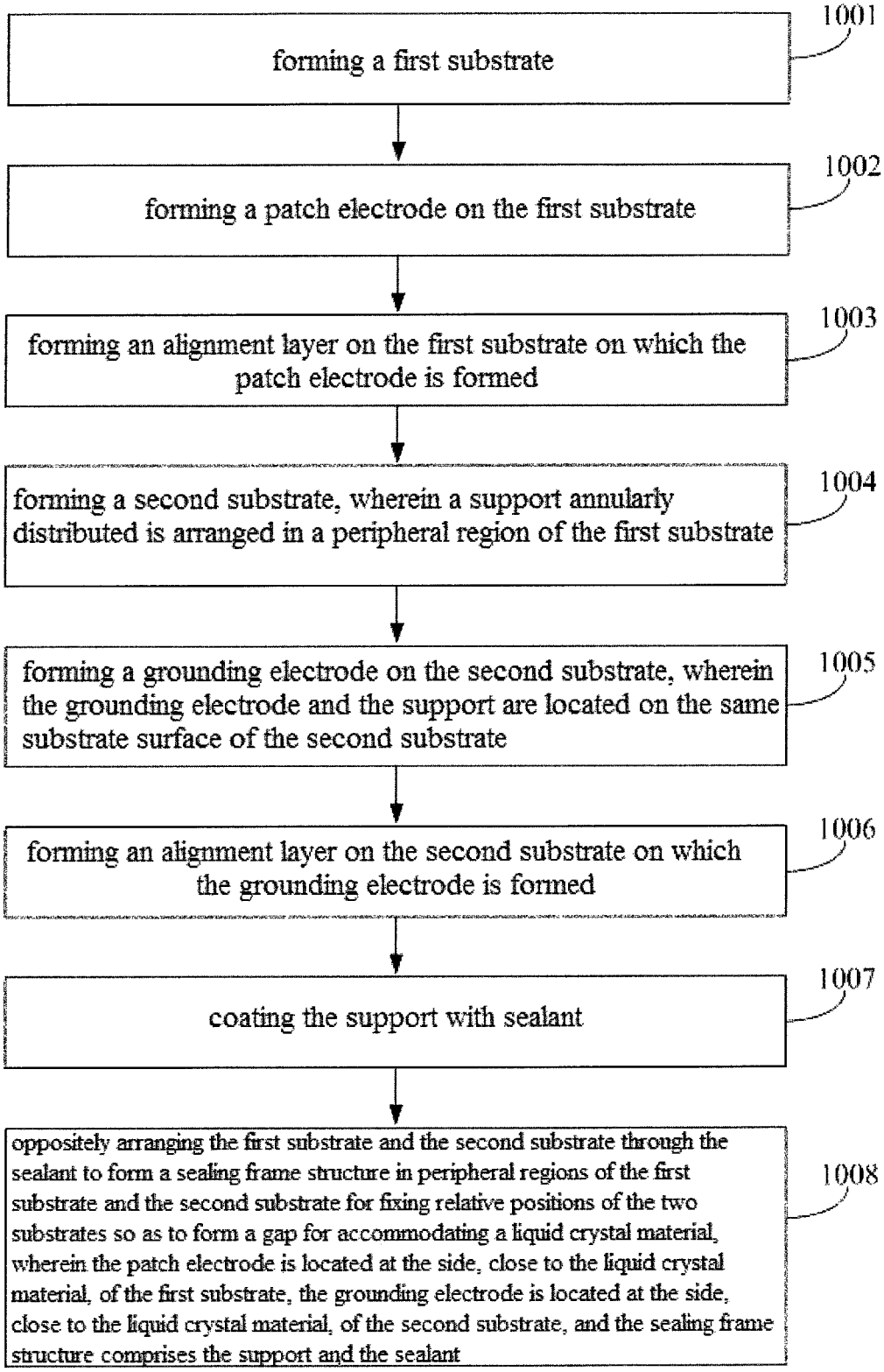
FIG. 10 is a flow chart of another manufacturing method of a liquid crystal antenna provided in an embodiment of the present disclosure.

With reference to FIG. 10 which shows a method flow chart of a manufacturing method for another phase shifter provided in the embodiments of the present disclosure. This embodiment gives the description by taking the phase shifter 10 shown in FIG. 7 as an example. With reference to FIG. 10, the method comprises the steps as follows.

Step 1001 includes forming a first substrate.

The first substrate may be a transparent substrate, and specifically may be a substrate made of light-guide and non-metallic materials having a certain robustness such as glass, quartz and transparent resin, or the first substrate may also be a non-transparent substrate. The implementation process of forming the first substrate may make reference to the related art, which is not repeated herein.

Step 1002 includes forming a patch electrode on the first substrate.

Figure 11:
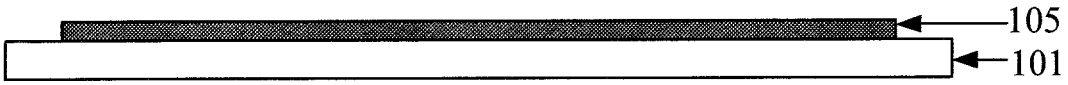
FIG. 11 is a diagram after forming a patch electrode on the first substrate provided in an embodiment of the present disclosure.

With reference to FIG. 11 which shows a diagram after forming the patch electrode 105 on the first substrate 101, provided in the embodiments of the present disclosure. The patch electrode 105 may be formed by adopting metal Mo, metal Cu, metal Al and an alloy material thereof or the patch electrode 105 may be formed by adopting ITO or IZO. The thickness of the patch electrode 105 may be set according to actual demands. The structure of the patch electrode 105 may make reference to the related art, which is not repeated herein.

The description is given by taking an example in which the patch electrode 105 is formed by adopting metal Cu.

Exemplarily, the patch electrode 105 may be obtained by depositing a layer of metal Cu having a certain thickness on the first substrate 101 by adopting magnetron sputtering, thermal evaporation, plasma enhanced chemical vapor deposition (PECVD) or the like to obtain metal Cu material layer; and the processing the metal Cu material layer through a one-time patterning process. The one-time patterning process comprises photoresist coating, exposure, developing, etching, and photoresist stripping. Therefore, said processing the metal Cu material layer through a one-time patterning process to obtain the patch electrode 105 may comprise: coating the metal Cu material layer with a photoresist having a certain thickness to obtain a photoresist layer; exposing the photoresist layer by adopting a mask, so that the photoresist layer forms a completely-exposed region and a non-exposed region; adopting a developing process for processing, so that the photoresist in the completely-exposed region is completely removed, and all the photoresist in the non-exposed region is retained; then etching a region corresponding to the completely-exposed region on the metal Cu material layer by adopting an etching process; and stripping the photoresist in the non-exposed region, so that the patch electrode 105 is formed in a region corresponding to the non-exposed region on the metal Cu material layer. It should be noted that the embodiment of the present embodiment is described by taking an example in which the patch electrode 105 is formed by adopting a positive photoresist. In practical application, the patch electrode 105 may be formed by adopting a negative photoresist, which is not repeated herein.

Step 1003 includes forming an alignment layer on the first substrate on which the patch electrode is formed.

Figure 12:
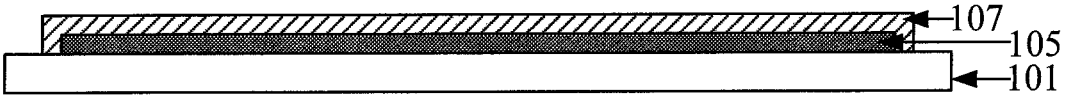
FIG. 12 is a diagram after forming an alignment layer on the first substrate on which a patch electrode is formed provided in an embodiment of the present disclosure.

With reference to FIG. 12, which shows a diagram after forming the alignment layer 107 on the first substrate 101 on which the patch electrode 105 is formed, provided in the embodiments of the present disclosure. The alignment layer 107 may be formed by adopting PI. Exemplarily, the alignment layer 107 may be obtained by coating the first substrate 101, on which the patch electrode 105 is formed, with a layer of PI by adopting a coating process to form a PI film, and then rubbing the PI film by adopting a rubbing process. Or The alignment layer 107 may be formed on the first substrate 101, on which the patch electrode 105 is formed, by wrapping a side surface of a roller with a transfer plate impregnated with a PI solution and fixing the transfer plate and the roller; rolling the roller wrapped with the transfer plate, on the first substrate 101, on which the patch electrode 105 is formed; printing the PI solution on the first substrate 101, on which the patch electrode 105 is formed; and heating the coated PI solution to volatilize an organic solvent in the PI solution and retain solute on the first substrate 101, on which the patch electrode 105 is formed.

Step 1004 includes forming a second substrate, wherein a support annularly distributed is arranged in a peripheral region of the first substrate.

Figure 13:
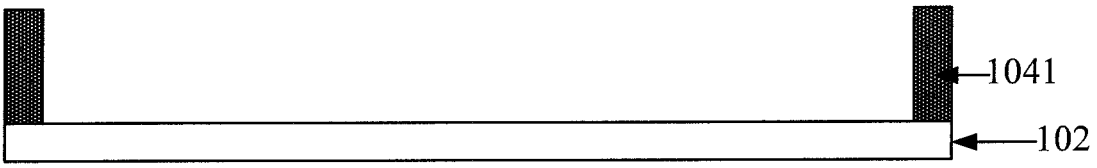
FIG. 13 is a structural diagram of a second substrate provided in an embodiment of the present disclosure.

With reference to FIG. 13, which shows a structural diagram of a second substrate 102 provided in the embodiments of the present disclosure. With reference to FIG. 13, the support 1041 annularly distributed is arranged in the peripheral region of the second substrate 102. The support 1041 is provided with a wiring groove (not shown in FIG. 13). The support 1041 may be integrally formed with the second substrate 102. In the manufacturing process of the second substrate 102, the support 1041 is integrally formed with the second substrate 102. The second substrate 102 may be a transparent substrate, and specifically may be a substrate made of light-guide and non-metallic materials having a certain robustness such as glass, quartz and transparent resin, or the second substrate 102 may also be a non-transparent substrate. The implementation process of forming the second substrate 102 may make reference to the related art, which is not repeated herein.

Step 1005 includes forming a grounding electrode on the second substrate, wherein the grounding electrode and the support are located on the same substrate surface of the second substrate.

Figure 14:
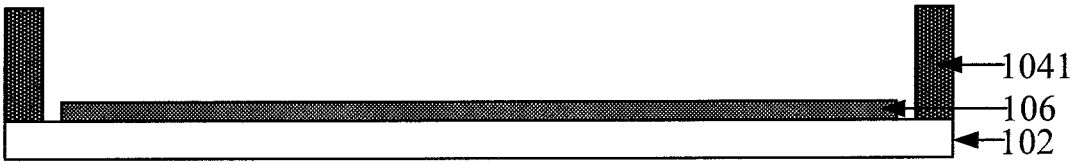
FIG. 14 is a diagram after forming a grounding electrode on the second substrate provided in an embodiment of the present disclosure.

With reference to FIG. 14 which shows a diagram after forming the grounding electrode 106 on the second substrate 102, provided in the embodiments of the present disclosure. With reference to FIG. 14, the grounding electrode 106 and the support 1041 are located on the same substrate surface of the second substrate 102, and the grounding electrode 106 is located in a central region of the second substrate 102 and the support 1041 is located in a peripheral region of the second substrate 102. The grounding electrode 106 may be formed by adopting metal Mo, metal Cu, metal Al and an alloy material thereof or the grounding electrode 106 may be formed by adopting ITO or IZO. The thickness of the grounding electrode 106 may be set according to actual demands. The structure of the grounding electrode 106 may make reference to related art, which is not repeated herein.

The description is given by taking an example in which the grounding electrode 106 is formed by adopting metal Al. Exemplarily, the grounding electrode 106 may be obtained by depositing a layer of metal Al having a certain thickness on the surface, on which the support 1041 is arranged, of the second substrate 102 by adopting magnetron sputtering, thermal evaporation, PECVD or the like to obtain a metal Al material layer, and then processing the metal Al material layer through the one-time patterning process. The process of obtaining the grounding electrode 106 by processing the metal Al material layer through the one-time patterning process is similar to that of obtaining the patch electrode 105 by processing the metal Cu material layer through the one-time patterning process in step 1002, which is not repeated herein.

Step 1006 includes forming an alignment layer on the second substrate on which the grounding electrode is formed.

Figure 15:
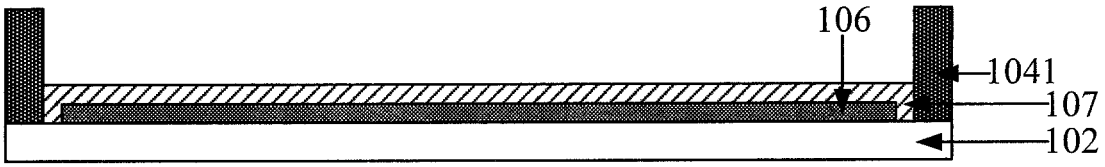
FIG. 15 is a diagram after forming an alignment layer on the second substrate on which a grounding electrode is formed provided in an embodiment of the present disclosure.

With reference to FIG. 15, which shows a diagram after forming the alignment layer 107 on the second substrate 102 on which the grounding electrode 106 is formed, provided in the embodiments of the present disclosure. The implementation process of the step 1006 may make reference to step 1003 above, and is not repeated herein.

Step 1007 includes coating the support with sealant.

Figure 16:
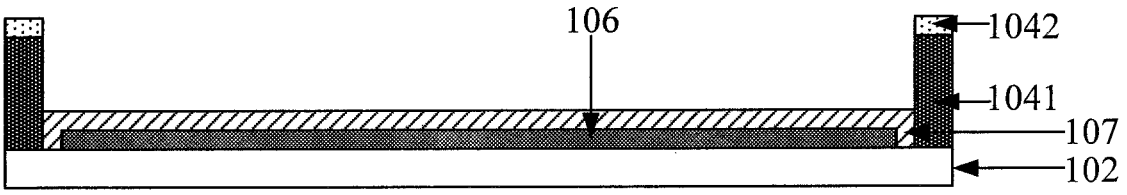
FIG. 16 is a diagram after coating the support with a sealant.

With reference to FIG. 16 which shows a diagram after coating the support 1041 with the sealant 1042, provided in the embodiments of the present disclosure. The support 1041 may be coated with the sealant 1042 by adopting a coating process, and an interior of the wiring groove of the support 1041 may be coated with the sealant 1042. The implementation process of coating of the sealant 1042 may make reference to related art, and is not repeated herein.

Step 1008 includes oppositely arranging the first substrate and the second substrate through the sealant to form a sealing frame structure in peripheral regions of the first substrate and the second substrate for fixing relative positions of the two substrates so as to form a gap for accommodating a liquid crystal material, wherein the patch electrode is located at the side, close to the liquid crystal material, of the first substrate, the grounding electrode is located at the side, close to the liquid crystal material, of the second substrate, and the sealing frame structure comprises the support and the sealant.

A diagram after oppositely arranging the first substrate 101 and the second substrate 102 through the sealant 1042 may make reference to FIG. 7. With reference to FIG. 7, the sealing frame structure 104 in the peripheral regions of the first substrate 101 and the second substrate 102 is used for fixing relative positions of the two substrates to form the gap for accommodating the liquid crystal material 103. The patch electrode 105 is located at the side, close to liquid crystals 103, of the first substrate 101 and the grounding electrode 106 is located at the side, close to the liquid crystals 103, of the second substrate 102. The sealing frame structure 104 comprises the support 1041 and the sealant 1042.

In some embodiments, the phase shifter 10 shown in FIG. 7 may be obtained by firstly dropping liquid crystals in a central region on the surface, on which the alignment layer 107 is formed, of the first substrate 101; making the surface, provided with the liquid crystals, of the first substrate 101 opposite to the surface, provided with the alignment layer 107, of the second substrate 102; applying fitting pressure to the first substrate 101 and the second substrate 102 to enable the first substrate 101 to be bonded to the support 1041 through the sealant 1042; and finally curing the sealant 1042. Or the phase shifter 10 shown in FIG. 7 may be obtained by firstly dropping liquid crystals in a central region on the surface, on which the alignment layer 107 is formed, of the second substrate 102; making the surface, provided with the liquid crystals, of the second substrate 102 opposite to the surface, provided with the alignment layer 107, of the first substrate 101; applying fitting pressure to the first substrate 101 and the second substrate 102 to enable the first substrate 101 to be bonded to the support 1041 through the sealant 1042; and finally curing the sealant 1042. It should be noted that the sealant usually comprises a heat-curing component and a photosensitive component. Therefore, said curing the sealant 1042 may comprise: firstly arranging the first substrate 101 and the second substrate 102, which are oppositely arranged, in a ultraviolet (UV) curing chamber; illuminating the sealant by adopting ultraviolet, so that the photosensitive component in the sealant is curd under the illumination of the ultraviolet; and then arranging the first substrate 101 and the second substrate 102, which are oppositely arranged, in a high-temperature furnace for heating the sealant, so that the heat-curing component in the sealant is cured. Of course, in practical application, the heat-curing component in the sealant may be cured firstly and then the photosensitive component in the sealant is cured. This is not limited in the embodiments of the present disclosure.

It should be noted that the embodiment of the present disclosure is described by taking an example, in which the support 1041 is arranged in the peripheral region of the second substrate 102. In practical application, when the support 1041 is arranged in the peripheral region of the first substrate 101, the steps 1001 to 1008 above may be as follows.

Step 1001*a* includes forming a first substrate, wherein a support annularly distributed is arranged in a peripheral region of the first substrate.

Step 1002*a* includes forming a patch electrode on the first substrate, wherein the patch electrode and the support are located on the same substrate surface of the first substrate.

Step 1003*a* includes forming an alignment layer on the first substrate on which the patch electrode is formed.

Step 1004*a* includes forming a second substrate.

Step 1005*a* includes forming a grounding electrode on the second substrate.

Step 1006*a* includes forming an alignment layer on the second substrate on which the grounding electrode is formed.

Step 1007*a* includes coating the support with sealant.

Step 1008*a* includes oppositely arranging the first substrate and the second substrate through the sealant to form a sealing frame structure in peripheral regions of the first substrate and the second substrate for fixing relative positions of the two substrates so as to form a gap for accommodating a liquid crystal material, wherein the patch electrode is located at the side, close to the liquid crystal material, of the first substrate, the grounding electrode is located at the side, close to the liquid crystal material, of the second substrate, and the sealing frame structure comprises the support and the sealant.

The implementation process of the steps 1001*a* to 1008*a* above is the same as or similar to that of the steps 1001 to 1008 above, and is not repeated herein.

To sum up, in the manufacturing method for the phase shifter provided in the embodiments of the present disclosure, the sealing frame structure comprises the support and the sealant, and the gap between the first substrate and the second substrate is maintained by adopting the support and the sealant, so that the problem of sealant collapse caused by coating of the sealant for multiple times may be avoided. Therefore, the problem in the related art that the adjusting range of the resonant frequency of the liquid crystal antenna is relatively narrow because it is difficult to maintain the gap between the first substrate and the second substrate is solved, thereby facilitating the increase in the adjusting range of the resonant frequency of the liquid crystal antenna.

In the embodiments of the present disclosure, a liquid crystal antenna is further provided. The liquid crystal antenna comprises at least one phase shifter 10 shown in FIG. 2 or at least one phase shifter 10 shown in any of FIGS. 6 to 8. When the liquid crystal antenna comprises a plurality of phase shifters, the plurality of phase shifters may be arranged in a matrix. When a voltage is applied to the grounding electrode and the patch electrode of the phase shifter, an electric field is formed between the first substrate and the second substrate. The electric field drives liquid crystals to deflect to adjust the resonant frequency of the phase shifter. Thus, the resonant frequency of the liquid crystal antenna is adjusted.

Figure 17:
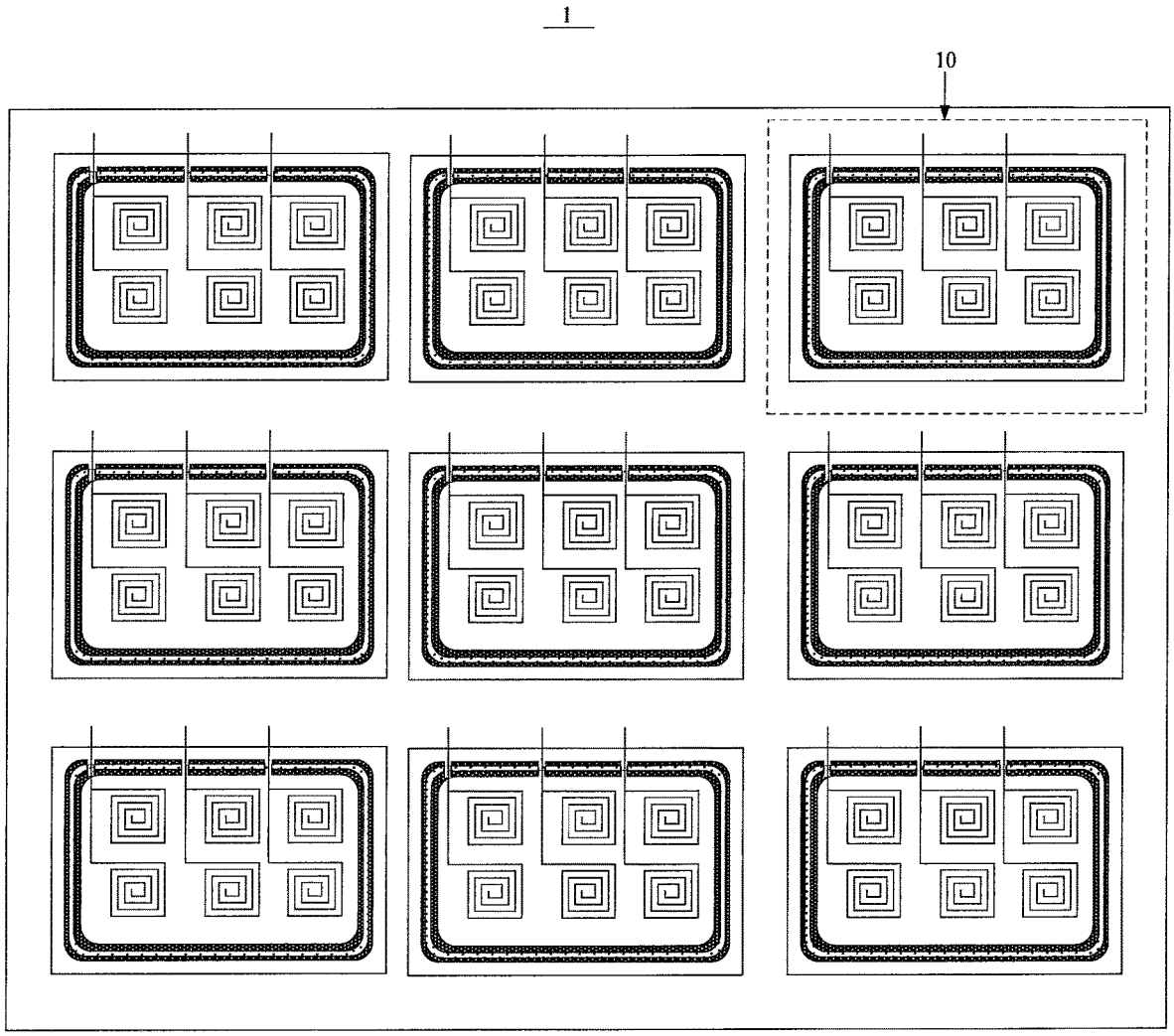
FIG. 17 is a structural diagram of an antenna provided in an embodiment of the present disclosure.

Exemplarily, with reference to FIG. 17, which shows a structural diagram of a liquid crystal antenna 1 provided in the embodiments of the present disclosure. With reference to FIG. 17, the liquid crystal antenna 1 comprises 9 phase shifters 10. In practical application, the liquid crystal antenna 1 may comprise a bearing portion (e.g., a bearing plate or the like). The phase shifters 10 may be arranged on the bearing plate. This is not limited in the embodiments of the present disclosure.

A communication device is further provided in the embodiment of the present disclosure. The communication device comprises a liquid crystal antenna. The liquid crystal antenna may be the liquid crystal antenna 1 shown in FIG. 17. The communication device may be a smart phone, a tablet computer, a smart television or the like.

Persons of ordinary skill in the art can understand that all or part of the steps described in the above embodiments can be completed through hardware, or through relevant hardware instructed by application stored in a non-transitory computer readable storage medium, such as read-only memory, disk or CD, etc.

The foregoing are only preferred embodiments of the present disclosure, and are not intended to limit the present disclosure. Within the spirit and principles of the disclosure, any modifications, equivalent substitutions, improvements, etc., are within the scope of protection of the present disclosure.

What is claimed is:

1. A phase shifter comprising:

a first substrate and a second substrate which are oppositely arranged; and a sealing frame structure located in peripheral regions of the first substrate and the second substrate for fixing relative positions of the two substrates to form a gap for accommodating a liquid crystal material, wherein the sealing frame structure comprises a support, and sealant for bonding to the first substrate, on the support, wherein the support is annularly distributed in the peripheral region of the first substrate, or the support is annularly distributed in the peripheral region of the second substrate, wherein the support is provided with a wiring groove, and the wiring groove is used for distribution of a lead of the phase shifter, and wherein the phase shifter further comprises: a plurality of coils, wherein a terminal of each of the coils extends out from a region defined by the support, through the wiring groove on the support.

2. The phase shifter according to claim 1, wherein the sealing frame structure further comprises sealant for bonding to the second substrate, on the support.

3. The phase shifter according to claim 1, wherein a forming material of the support is the same as that of the first substrate or that of the second substrate.

4. The phase shifter according to claim 3, wherein the support is integrally formed with the first substrate; or the support is integrally formed with the second substrate.

5. The phase shifter according to claim 1, wherein the support is integrally formed with the first substrate; or the support is integrally formed with the second substrate.

6. The phase shifter according to claim 1, wherein the phase shifter further comprises:

an alignment layer arranged on at least one of the first substrate and the second substrate.

7. The phase shifter according to claim 1, wherein a patch electrode is arranged at the side, close to the liquid crystal material, of the first substrate, and a grounding electrode is arranged at the side, close to the liquid crystal material, of the second substrate, or the grounding electrode is arranged at the side, close to the liquid crystal material, of the first substrate, and the patch electrode is arranged at the side, close to the liquid crystal material, of the second substrate.

8. A manufacturing method for a phase shifter, the method comprising:

forming a first substrate and a second substrate, wherein a sealing frame structure comprises a support, and sealant for bonding to the first substrate, on the support, wherein the support is formed on the first substrate and the support is annularly distributed in the peripheral region of the first substrate, or the support is formed on the second substrate and the support is annularly distributed in the peripheral region of the second substrate; and oppositely arranging the first substrate and the second substrate to form the sealing frame structure in peripheral regions of the first substrate and the second substrate for fixing relative positions of the two substrates to form a gap for accommodating a liquid crystal material, wherein the support is provided with a wiring groove, and the wiring groove is used for distribution of a lead of the phase shifter, and wherein the phase shifter further comprises: a plurality of coils, wherein a terminal of each of the coils extends out from a region defined by the support, through the wiring groove on the support.

9. The method according to claim 8, wherein the sealing frame structure further comprises sealant for bonding to the second substrate, on the support;

or a forming material of the support is the same as that of the first substrate or that of the second substrate.

10. The method according to claim 8, wherein the support is integrally formed with the first substrate; or the support is integrally formed with the second substrate.

11. The method according to claim 8, wherein said oppositely arranging the first substrate and the second substrate to form the sealing frame structure in peripheral regions of the first substrate and the second substrate comprises:

coating the support with the sealant; and oppositely arranging the first substrate and the second substrate through the sealant to form the sealing frame structure in peripheral regions of the first substrate and the second substrate.

12. A liquid crystal antenna comprising at least one phase shifter, wherein each phase shifter comprises:

a first substrate and a second substrate which are oppositely arranged; and a sealing frame structure located in peripheral regions of the first substrate and the second substrate for fixing relative positions of the two substrates to form a gap for accommodating a liquid crystal material, wherein the sealing frame structure comprises a support, and sealant for bonding to the first substrate, on the support, wherein the support is annularly distributed in the peripheral region of the first substrate, or the support is annularly distributed in the peripheral region of the second substrate, wherein the support is provided with a wiring groove, and the wiring groove is used for distribution of a lead of the phase shifter, and wherein the phase shifter further comprises: a plurality of coils, wherein a terminal of each of the coils extends out from a region defined by the support, through the wiring groove on the support.

13. The liquid crystal antenna according to claim 12, wherein the sealing frame structure further comprises sealant for bonding to the second substrate, on the support.

14. The liquid crystal antenna according to claim 12, wherein a forming material of the support is the same as that of the first substrate or that of the second substrate.

15. A communication device comprising the liquid crystal antenna according to claim 12.

* * * * *